US007241228B2

(12) United States Patent
Bruschi

(10) Patent No.: US 7,241,228 B2
(45) Date of Patent: Jul. 10, 2007

(54) GOLF SWING ALIGNMENT DEVICE

(76) Inventor: Dale A. Bruschi, 920 Washington St., Hollywood, FL (US) 33019

( * ) Notice: Subject to any disclaimer, the term of this patent is extended or adjusted under 35 U.S.C. 154(b) by 0 days.

(21) Appl. No.: 11/230,241

(22) Filed: Sep. 19, 2005

(65) Prior Publication Data

US 2006/0063603 A1 Mar. 23, 2006

Related U.S. Application Data

(60) Provisional application No. 60/610,740, filed on Sep. 17, 2004.

(51) Int. Cl.
*A63B 69/36* (2006.01)

(52) U.S. Cl. ..... 473/218; 473/257; 473/266; 473/270

(58) Field of Classification Search ..... 473/218, 473/257, 266, 267, 268, 269, 270, 271, 272
See application file for complete search history.

(56) References Cited

U.S. PATENT DOCUMENTS

| | | | | | |
|---|---|---|---|---|---|
| 1,781,230 | A | * | 11/1930 | Hill | 273/108.21 |
| 2,169,407 | A | * | 8/1939 | Crowley | 473/272 |
| 4,784,393 | A | * | 11/1988 | Williams et al. | 473/272 |
| 5,110,132 | A | * | 5/1992 | Weston et al. | 473/272 |
| 5,246,234 | A | * | 9/1993 | Zambelli | 473/272 |
| 6,106,408 | A | * | 8/2000 | Roman | 473/266 |

* cited by examiner

*Primary Examiner*—Nini F. Legesse
(74) *Attorney, Agent, or Firm*—Ruden McClosky; Stanley A. Kim

(57) ABSTRACT

Devices and methods for aligning an individual's golf swing have been developed. The devices and methods help a golfer to properly position a golf ball and to properly execute a swing, increasing the likelihood of an accurately hit golf shot. Golf swing alignment devices of the invention are collapsible such that they can be stored within a golf bag when not in use.

18 Claims, 3 Drawing Sheets

GOLF SWING ALIGNMENT DEVICE

CROSS-REFERENCE TO RELATED APPLICATION

The present application claims the priority of U.S. provisional patent application No. 60/610,740 filed Sep. 17, 2004.

FIELD OF THE INVENTION

The invention relates generally to the field of golf and more particularly to a device and method for aligning a golf ball directly at a target while also aligning a golfer's feet and shoulders properly to the target line.

BACKGROUND OF THE INVENTION

Ideally, in addressing the hitting of a golf ball, the golfer should be positioned with the toes of both feet on a line parallel to an imaginary target line for the shot. The stance should also position the ball so that a line intersecting the ball and perpendicular to the target line passes slightly inside of the forward-most heel of the golfer. Finally, the clubface should be "square" to the ball, that is, perpendicular to the target line at the point of impact of the clubface with the ball. A stance as described above results in the feet, hips and shoulders being aligned parallel to the target line at address, the ball being positioned properly in the stance and a square club face at the moment of impact, all of which maximizes the likelihood of an accurately hit golf shot.

When a practice shot wanders from its intended mark, golfers will often lay the shaft of the club that was used for the shot across their toes while holding their finish position and then step back and observe the alignment of the club. Frequently, the club shaft is aligned with the actual flight line of the target rather than parallel to the intended target line, indicating that the error was the result of improper alignment of the feet and shoulders at address. This procedure is of no use in actually achieving proper foot alignment, ball positioning or club face squaring. It is merely a post-shot spot check method for identifying one possible cause of inaccuracy.

It is not uncommon for a golfer who is working on the practice tee to improve accuracy to lay a club on the ground on a line parallel to the target line as a guide for foot alignment before taking a practice shot. While this procedure does assist in proper foot alignment, it does not help in proper ball positioning or clubface squaring. Furthermore, since it does not properly position the ball or square the clubface, the procedure affords only incomplete data as to the real causes of any inaccuracy in the completed shot. The aforementioned procedure of using a golf club for an alignment check is inconvenient, because the tool is already in the golf bag. No adequate single tool exists that facilitates correct foot alignment, correct golf ball target alignment and club face squaring, much less one which is simple to use, easy to carry and fits in the golf bag.

SUMMARY OF THE INVENTION

The invention relates to the development of a device and method for aligning an individual's golf swing. The alignment device positions the golf ball such that the ball is aligned to the target line, and properly aligns the golfer's feet and shoulders parallel left of the target. The devices and methods help a golfer to properly position a golf ball and to properly execute a swing, increasing the likelihood of an accurately hit golf shot. Golf swing alignment devices of the invention are collapsible such that they can be stored within a golf bag when not in use.

Accordingly, the invention features a golf swing alignment device. This device includes a central post member operatively engaged to a first alignment bar by a connector, the central post member positioned perpendicular to the first alignment bar forming two feet positioning areas that are disposed on either side of and bisected by the central post member, the first alignment bar having a first end opposite a second end, the first end engaging a first hinge member and a second alignment bar in a hinging engagement, the first end slidably engaged to the second alignment bar, the second end engaging a second hinge member and a third alignment bar in a hinging engagement, the second end slidably engaged to the third alignment bar, the second alignment bar further operatively engaging a third hinge member and a fourth alignment bar in a hinging engagement, the second alignment bar slidably engaged to the fourth alignment bar, the third alignment bar further operatively engaging a fourth hinge member and a fifth alignment bar in a hinging engagement, the third alignment bar slidably engaged to the fifth alignment bar. In this device, the fourth and fifth alignment bars are substantially parallel to the first alignment bar, and positioning of the second alignment bar, the third alignment bar, the fourth alignment bar, and the fifth alignment bar in relation to the first alignment bar forms a ball positioning area. The first, second, third and fourth hinge members can be releasably lockable. The first hinge member can position the second alignment bar in a plurality of releasably securable positions with respect to the first end of the first alignment bar, the second hinge member can position the third alignment bar in a plurality of releasably securable positions with respect to the second end of the first alignment bar, the third hinge member can position the fourth alignment bar in a plurality of releasably securable positions with respect to the second alignment bar, and the fourth hinge member can position the fifth alignment bar in a plurality of releasably securable positions with respect to the third alignment bar. The central post member, the first alignment bar, the second alignment bar, the third alignment bar, the fourth alignment bar, and the fifth alignment bar can be made of a material such as plastic, wood, or metal. Preferably, when the golf ball is positioned within the ball positioning area, the golf ball is aligned with the central post member, the fourth alignment bar, and the fifth alignment bar. In preferred embodiments, a golf alignment device is collapsible for storage in a golf bag.

In another aspect, the invention features a method for aligning a golf swing. This method includes the steps of: (a) providing a golf ball and a golf swing alignment device, the device including a central post member operatively engaged to a first alignment bar by a connector, the central post member positioned perpendicular to the first alignment bar forming two feet positioning areas that are disposed on either side of and bisected by the central post member, the first alignment bar having a first end opposite a second end, the first end engaging a first hinge member and a second alignment bar in a hinging engagement, the first end slidably engaged to the second alignment bar, the second end engaging a second hinge member and a third alignment bar in a hinging engagement, the second end slidably engaged to the third alignment bar, the second alignment bar further operatively engaging a third hinge member and a fourth alignment bar in a hinging engagement, the second alignment bar slidably engaged to the fourth alignment bar, the third alignment bar further operatively engaging a fourth hinge member and a fifth alignment bar in a hinging engagement, the third alignment bar slidably engaged to the fifth alignment bar, wherein the fourth and fifth alignment bars are substantially parallel to the first alignment bar, and positioning of the second alignment bar, the third alignment bar, the fourth alignment bar, and the fifth alignment bar in relation to the first alignment bar forms a ball positioning area; and (b) positioning the golf ball within the ball positioning area formed by the golf swing alignment device.

In this method, the first, second, third and fourth hinge members are releasably lockable. The first hinge member can position the second alignment bar in a plurality of releasably securable positions with respect to the first end of the first alignment bar, the second hinge member can position the third alignment bar in a plurality of releasably securable positions with respect to the second end of the first alignment bar, the third hinge member can position the fourth alignment bar in a plurality of releasably securable positions with respect to the second alignment bar, and the fourth hinge member can position the fifth alignment bar in a plurality of releasably securable positions with respect to the third alignment bar. In this method, the positioned golf ball is aligned with the central post member, the fourth alignment bar, and the fifth alignment bar. The central post member, the first alignment bar, the second alignment bar, the third alignment bar, the fourth alignment bar, and the fifth alignment bar can be made of a material such as plastic, wood, or metal. In preferred embodiments, the device is collapsible for storage in a golf bag.

Unless otherwise defined, all technical and legal terms used herein have the same meaning as commonly understood by one of ordinary skill in the art to which this invention belongs. Although devices and methods similar or equivalent to those described herein can be used in the practice or testing of the present invention, suitable devices and methods are described below. All patent applications mentioned herein are incorporated by reference in their entirety. In case of conflict, the present specification, including definitions, will control. In addition, the devices, methods, and examples are illustrative only and not intended to be limiting. Other features and advantages of the invention will be apparent from the following detailed description, and from the claims.

DETAILED DESCRIPTION OF THE INVENTION

Figure 1:
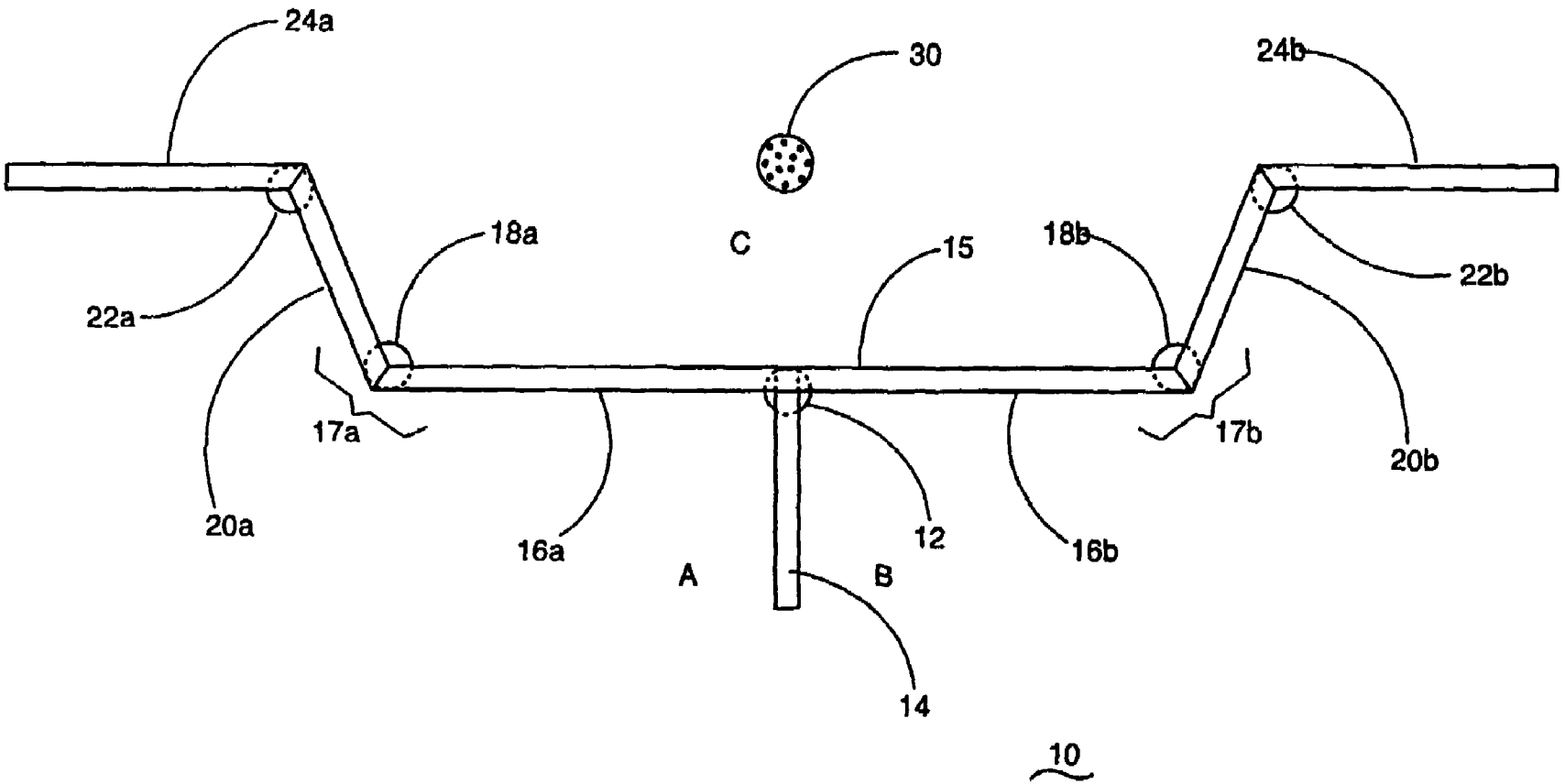
FIG. 1 is a top view illustration of the preferred embodiment of the present invention.
Figure 2:
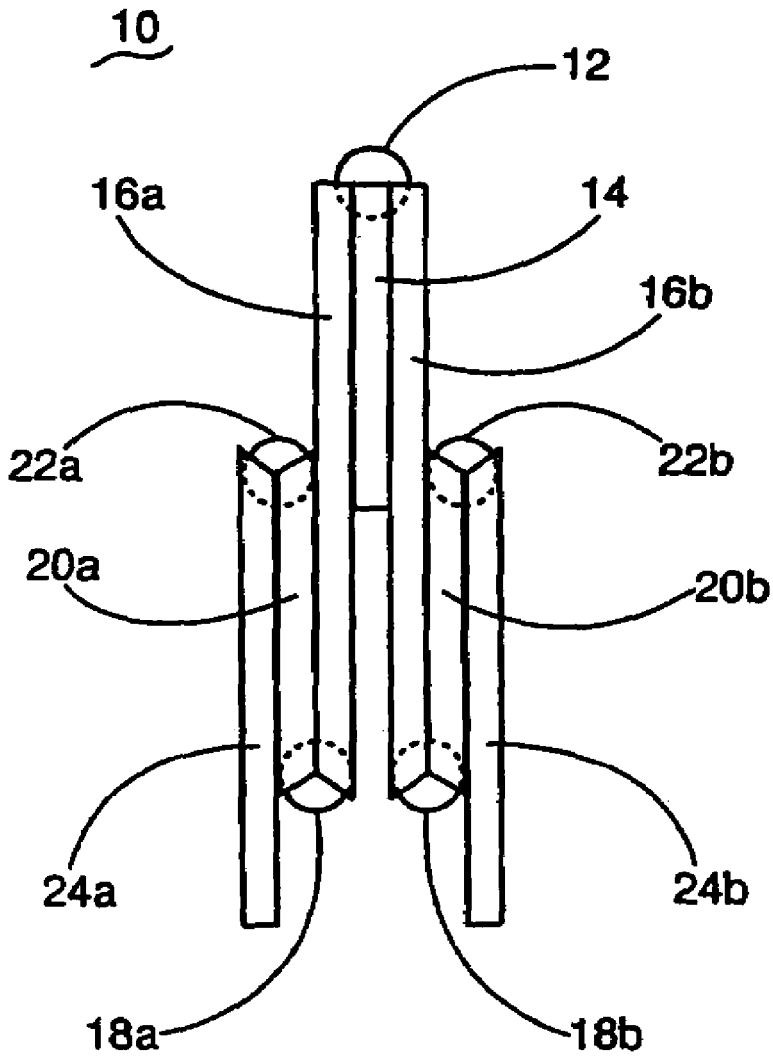
FIG. 2 is a top view illustration of the preferred embodiment of the present invention of FIG. 1, shown in the folded position for storage.
Figure 3:
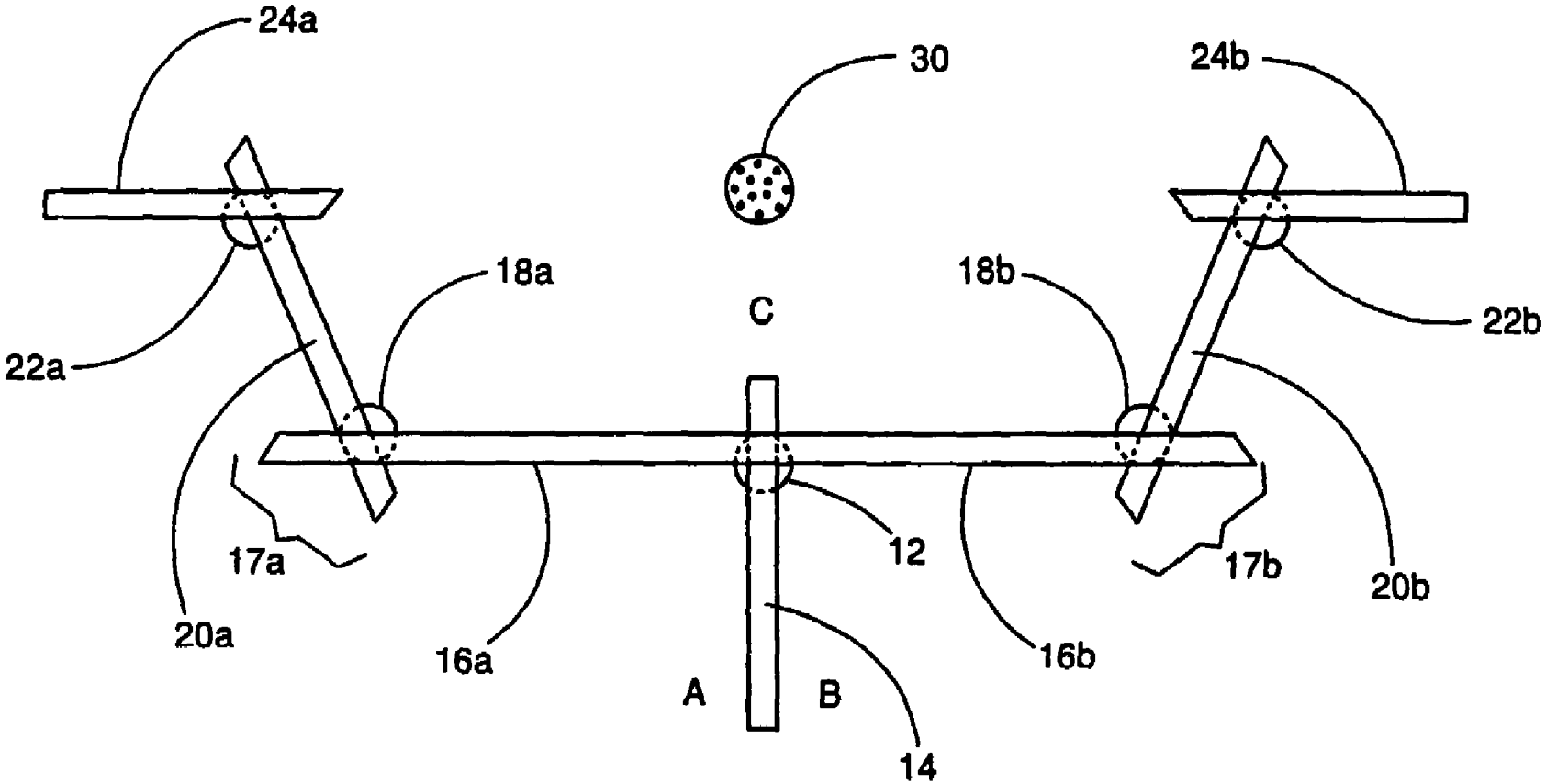
FIG. 3 is a top view illustration of the preferred embodiment of the present invention of FIG. 1 in an alternative configuration.

The invention encompasses devices and methods for aligning an individual's golf swing. An exemplary golf swing alignment device is shown in FIGS. 1-3. The exemplary golf alignment device described herein is for use with a variety of golf clubs (e.g., irons, woods), by right-handed and left-handed golfers, and by golfers of various sizes and shapes. The below described exemplary embodiments illustrate adaptations of these devices and methods. Nonetheless, from the description of these embodiments, other aspects of the invention can be made and/or practiced based on the description provided below.

Referring now to FIG. 1, the preferred embodiment of the present invention is illustrated as golf swing alignment device 10. Golf swing alignment device 10 includes central post member 14 and first alignment bar 15.

Central post member 14 is operatively engaged to first alignment bar 15 by connector 12. Connector 12 permits central post member 14 to pass at least partially therethrough, so as to allow central post member 14 to cross first alignment bar 15 between first alignment bar portions 16*a* and 16*b*. A connector 12 can be any suitable device that operably connects the central post member 14 to the first alignment bar 15. As illustrated in FIG. 3, central post member 14 is capable of passing through first alignment bar 15 so as to allow for better alignment based upon the use of a particular club, such as an iron. The positioning of central post member 14 in relation to first alignment bar portions 16*a* and 16*b* forms feet positioning areas "A" and "B" for placement of the golfer's feet.

First alignment bar 15 further includes a first end 17*a* opposite a second end 17*b*. First end 17*a* engages a second alignment bar 20*a* in a hinging engagement, preferably utilizing a selectively releasable lockable hinge member 18*a*. A releasably lockable hinge member is one that can be operated in a locked position in which the alignment bar with which the hinge member is engaged cannot move freely as well as in a non-locked position, allowing the alignment bar to move freely. It will be appreciated that a hinge member as described herein includes any suitable hinge mechanism that can be used for proper engaging and sliding of the different components of the device of the invention. As shown in FIG. 3, first end 17*a* is also slidably engaged to second alignment bar 20*a* so as to permit adjustment of the size of ball positioning area "C" for use with a particular club size. Selectively releasable lockable hinge member 18*a* is preferably capable of positioning second alignment bar 20*a* in a plurality of releasably securable positions with respect to first end 17*a* of first alignment bar 15.

Similarly, second end 17*b* likewise engages a third alignment bar 20*b* in a hinging engagement, also preferably utilizing a selectively releasable lockable hinge member 18*b*. As is further shown in FIG. 3, second end 17*b* is also slidably engaged to third alignment bar 20*b* so as to permit adjustment of the size of ball positioning area "C" for use with a particular club size. Selectively releasable lockable hinge member 18*b* is also preferably capable of positioning third alignment bar 20*b* in a plurality of releasably securable positions with respect to second end 17*b* of first alignment bar 15.

Second alignment bar 20*a* further operatively engages a fourth alignment bar 24*a* in a hinging engagement, preferably utilizing another selectively releasable lockable hinge member 22*a*. Additionally, as illustrated in FIG. 3, second alignment bar 20*a* can slidably engage fourth alignment bar 24*a*, so as to better align golf ball 30. Selectively releasable lockable hinge member 22*a* is preferably capable of positioning fourth alignment bar 24*a* in a plurality of releasably securable positions with respect to second alignment bar 20*a*. Preferably, fourth alignment bar 24*a* is placed into a position substantially parallel to first alignment bar 15.

Third alignment bar 20*b* also operatively engages a fifth alignment bar 24*b* in a hinging engagement, preferably utilizing still another selectively releasable lockable hinge member 22*b*. Furthermore, as illustrated in FIG. 3, third alignment bar 20*b* can slidably engage fifth alignment bar

24*b*, so as to better align golf ball 30. Selectively releasable lockable hinge member 22*b* is also preferably capable of positioning fifth alignment bar 24*b* in a plurality of releasably securable positions with respect to third alignment bar 20*b*. Preferably, fifth alignment bar 24*b* is also placed into a position substantially parallel to first alignment bar 15.

The positioning of first alignment bar 15 in conjunction with second alignment bar 20*a*, third alignment bar 20*b*, fourth alignment bar 24*a*, and fifth alignment bar 24*b* forms ball positioning area "C." Preferably, a golf ball 30 is positioned within ball positioning area "C", with golf ball 30 more preferably aligned in line with central post member 14, fourth alignment bar 24*a* and fifth alignment bar 24*b* as shown in FIG. 1 and FIG. 3. Such alignment of golf ball 30 permits the user to achieve a golf ball position in a target line for the best possible golf swing. The size of area "C" can be adjusted by adjusting the positions of alignment bars 20*a*, 20*b*, 24*a*, and 24*b* with respect to hinge members 18*a*, 18*b*, 22*a*, and 22*b*.

The alignment bars (15, 20*a*, 20*b*, 24*a*, 24*b*) of the device are typically rounded but can be of any suitable shape. To provide resistance to impact by ball 30 and being stepped on by a golfer's feet, the alignment bars are preferably made of a rigid material such as metal, wood, plastic, or a polymer. In some embodiments, the central post member and the alignment bars are lightweight and hollow. The central post member and alignment bars can be any of a number of colors, and in some embodiments, are transparent or translucent. The dimensions of the central post member 14 and the alignment bars also can vary. The diameter or width of the central post member might range from about 0.25 inches to about 0.5 inches (e.g., 0.20, 0.21, 0.22, 0.25, 0.30, 0.35, 0.40, 0.45, 0.50, 0.55, 0.6 inches, etc.) and the length might range from about 12 inches to about 18 inches (e.g., 10, 11, 12, 13, 14, 15, 16, 17, 18, 19, 20 inches, etc.). The diameter or width of first alignment bar 15 might range from about 0.25 inches to about 0.5 inches (e.g., 0.20, 0.21, 0.22, 0.25, 0.30, 0.35, 0.40, 0.45, 0.50, 0.55, 0.6 inches, etc.) and the length might range from about 3 feet to about 5 feet (e.g., 2.8, 2.9, 3.0, 3.2, 3.4, 3.5, 3.6, 3.8, 4.0, 4.2, 4.4, 4.6, 4.8, 5.0, 5.2 feet, etc.). Alignment bars 20*a*, 20*b*, 24*a*, and 24*b* might have a diameter or width in the range from about 0.25 inches to about 0.5 inches (e.g., 0.20, 0.21, 0.22, 0.25, 0.30, 0.35, 0.40, 0.45, 0.50, 0.55, 0.6 inches, etc.). The length of second and third alignment bars (20*a* and 20*b*, respectively) might range from about 18 inches to about 36 inches (e.g., 17, 18, 19, 20, 22, 24, 26, 28, 30, 32, 34, 35, 36, 37, 38 inches, etc.). The length of fourth and fifth alignment bars (24*a* and 24*b*, respectively) might range from about 2 feet to 3 feet (e.g., 1.5, 1.7, 1.9, 2.0, 2.2, 2.4, 2.6, 2.8, 2.9, 3.0, 3.1, 3.2 feet, etc.) Although the dimensions of the central post member and the alignment bars can vary, it will be appreciated that alignment bars 20*a* and 20*b* are preferably the same size and that alignment bars 24*a* and 24*b* are preferably the same size.

The alignment device positions the golf ball in line with the target, properly aligning the golfer's feet and shoulders parallel left of the target. In use, the device is positioned on the ground such that fourth and fifth alignment bars (24*a* and 24*b*, respectively), are aligned in parallel with the intended direction that the golf ball is to be hit at an adjustable distance from the golf ball selected to be appropriate for the golfer. Once the device has been positioned, the golfer faces the first alignment bar 15 with his feet positioned on either side of the central post member 14, his left foot placed in feet positioning area A and his left foot placed in feet positioning area B. The fourth or fifth alignment bar (24*a* and 24*b*, respectively) provides the reference line for the direction of flight of the golf ball, depending on the handedness of the golfer. By aligning the fourth and fifth alignment bars with the target, the golfer's feet are positioned correctly. The fourth and fifth alignment bars are adjustable, and can be moved left and right and up and down in relation to the second and third alignment bars (20*a* and 20*b*, respectively). The central post member 14 and the second and third alignment bars can also be moved up and down and right and left in relation to the first alignment bar 15 to achieve the correct distance the golfer's feet should be from the golf ball while using any iron or wood. When the golfer swings, the head of the golf club passes over either fourth alignment bar 24*a* or fifth alignment bar 24*b*, depending on the handedness of the golfer, after hitting the ball.

Referring now to FIG. 2, golf swing alignment device 10 is illustrated in its collapsible (folded) position. By utilizing connector 12 and selectively releasable lockable hinge members 18*a*, 18*b*, 22*a*, and 22*b*, golf swing alignment device 10 can be folded upon itself to facilitate ease of storage in a golf bag. To collapse or fold the device, first alignment bar 15 can be folded so that first alignment bar portions 16*a* and 16*b* are positioned on either side of central post member 14. Selectively releasable lockable hinge members 18*a* and 18*b* can then be engaged so as to fold second alignment bar 20*a* and third alignment bar 20*b* into positions adjacent to first alignment bar portions 16*a* and 16*b*, respectively. In a similar manner, selectively releasable lockable hinge members 22*a* and 22*b* can then be engaged so as to fold fourth alignment bar 24*a* and fifth alignment bar 24*b* into positions adjacent to second alignment bar 20*a* and third alignment bar 20*b*, respectively. Such collapsibility permits the user to position golf swing alignment device 10 in a golf bag when not in use. To unfold the device, the above steps can be performed in reverse.

OTHER EMBODIMENTS

While the above description contains many specifics, these should not be construed as limitations on the scope of the invention, but rather as examples of preferred embodiments thereof. Many other variations are possible. Accordingly, the scope of the invention should be determined not by the embodiments illustrated, but by the appended claims and their legal equivalents.

What is claimed is:

1. A golf swing alignment device, the device comprising a central post member operatively engaged to a first alignment bar by a connector, the central post member positioned perpendicular to the first alignment bar forming two feet positioning areas that are disposed on either side of and bisected by the central post member, the first alignment bar comprising a first end opposite a second end, the first end engaging a first hinge member and a second alignment bar in a hinging engagement, the first end slidably engaged to the second alignment bar, the second end engaging a second hinge member and a third alignment bar in a hinging engagement, the second end slidably engaged to the third alignment bar, the second alignment bar further operatively engaging a third hinge member and a fourth alignment bar in a hinging engagement, the second alignment bar slidably engaged to the fourth alignment bar, the third alignment bar further operatively engaging a fourth hinge member and a fifth alignment bar in a hinging engagement, the third alignment bar slidably engaged to the fifth alignment bar, wherein the fourth and fifth alignment bars are substantially parallel to the first alignment bar, and wherein positioning of the second alignment bar, the third alignment bar, the fourth alignment bar, and the fifth alignment bar in relation to the first alignment bar forms a ball positioning area.

2. The golf swing alignment device of claim 1, wherein the first, second, third and fourth binge members are releasably lockable.

3. The golf swing alignment device of claim 1, wherein the first hinge member positions the second alignment bar in a plurality of releasably securable positions with respect to the first end of the first alignment bar.

4. The golf swing alignment device of claim 1, wherein the second hinge member positions the third alignment bar in a plurality of releasably securable positions with respect to the second end of the first alignment bar.

5. The golf swing alignment device of claim 1, wherein the third hinge member positions the fourth alignment bar in a plurality of releasably securable positions with respect to the second alignment bar.

6. The golf swing alignment device of claim 1, wherein the fourth hinge member positions the fifth alignment bar in a plurality of releasably securable positions with respect to the third alignment bar.

7. The golf swing alignment device of claim 1, wherein when the golf ball is positioned within the ball positioning area, the golf ball is aligned with the central post member, the fourth alignment bar, and the fifth alignment bar.

8. The golf swing alignment device of claim 1, wherein the device is collapsible for storage in a golf bag.

9. The golf swing alignment device of claim 1, wherein the central post member, the first alignment bar, the second alignment bar, the third alignment bar, the fourth alignment bar, and the fifth alignment bar are made of a material selected from the group consisting of: plastic, wood, and metal.

10. A method for aligning a golf swing, the method comprising the steps of:

(a) providing a golf ball and a golf swing alignment device, the device comprising a central post member operatively engaged to a first alignment bar by a connector, the central post member positioned perpendicular to the first alignment bar forming two feet positioning areas that are disposed on either side of and bisected by the central post member, the first alignment bar comprising a first end opposite a second end, the first end engaging a first hinge member and a second alignment bar in a hinging engagement, the first end slidably engaged to the second alignment bar, the second end engaging a second hinge member and a third alignment bar in a hinging engagement, the second end slidably engaged to the third alignment bar, the second alignment bar further operatively engaging a third hinge member and a fourth alignment bar in a hinging engagement, the second alignment bar slidably engaged to the fourth alignment bar, the third alignment bar further operatively engaging a fourth hinge member and a fifth alignment bar in a hinging engagement, the third alignment bar slidably engaged to the fifth alignment bar, wherein the fourth and fifth alignment bars are substantially parallel to the first alignment bar, and wherein positioning of the second alignment bar, the third alignment bar, the fourth alignment bar, and the fifth alignment bar in relation to the first alignment bar forms a ball positioning area; and (b) positioning the golf ball within the ball positioning area formed by the golf swing alignment device.

11. The method of claim 10, wherein the first, second, third and fourth hinge members are releasably lockable.

12. The method of claim 10, wherein the first hinge member positions the second alignment bar in a plurality of releasably securable positions with respect to the first end of the first alignment bar.

13. The method of claim 10, wherein the second hinge member positions the third alignment baring plurality of releasably securable positions with respect to the second end of the first alignment bar.

14. The method of claim 10, wherein the third hinge member positions the fourth alignment bar in a plurality of releasably securable positions with respect to the second alignment bar.

15. The method of claim 10, wherein the fourth binge member positions the fifth alignment bar in a plurality of releasably securable positions with respect to the third alignment bar.

16. The method of 10, wherein the positioned golf ball is aligned with the central post member, the fourth alignment bar, and the fifth alignment bar.

17. The method of claim 10, wherein the device is collapsible for storage, and the method further comprises the steps of collapsing the device and placing the collapsed device in a golf bag.

18. The method of claim 10, wherein the central post member, the first alignment bar, the second alignment bar, the third alignment bar, the fourth alignment bar, and the fifth alignment bar are made of a material selected from the group consisting of: plastic, wood, and metal.

* * * * *

UNITED STATES PATENT AND TRADEMARK OFFICE

CERTIFICATE OF CORRECTION

PATENT NO. : 7,241,228 B2
APPLICATION NO. : 11/230241
DATED : July 10, 2007
INVENTOR(S) : Dale A. Bruschi It is certified that error appears in the above-identified patent and that said Letters Patent is hereby corrected as shown below:

Column 7, line 6 “binge” should be changed to --hinge--.

Column 8, line 25, “baring” should be changed to --bar in a--.

Column 8, line 32, “binge” should be changed to --hinge--.

Column 8, line 36, insert --claim-- before “10”.

Signed and Sealed this

Twenty-first Day of August, 2007

JON W. DUDAS
*Director of the United States Patent and Trademark Office*